United States Patent [19]

De Brabander

[11] 3,943,981

[45] Mar. 16, 1976

[54] HOOKING-UP DEVICE

[75] Inventor: Jean Leon Philemon Isidor Pierre De Brabander, Hamme, Belgium

[73] Assignee: Velcro S.A., Nylon, Switzerland

[22] Filed: Mar. 25, 1974

[21] Appl. No.: 376,036

Related U.S. Application Data

[63] Continuation-in-part of Ser. No. 824,485, May 14, 1969, abandoned.

[30] Foreign Application Priority Data

Jan. 24, 1969 Belgium ..... 48739

[52] U.S. Cl. ..... 139/391; 139/421; 24/204; 28/72 P; 428/92; 428/99

[51] Int. Cl.[2] ..... D03D 27/00; A44B 17/00

[58] Field of Search ..... 28/72 P; 26/2; 24/204, 24/DIG. 18; 2/DIG. 6; 161/48, 62–67; 139/391, 421–423, 402, 403; 428/85, 92, 99

[56] References Cited

UNITED STATES PATENTS

| | | | |
|---|---|---|---|
| 351,570 | 10/1886 | Bidmead | 139/423 |
| 2,285,332 | 6/1942 | Gerbert | 139/403 |
| 2,597,580 | 5/1952 | Gluck | 139/421 UX |
| 2,717,437 | 9/1955 | De Mestral | 28/72 P |
| 3,009,235 | 11/1961 | De Mestral | 139/391 X |
| 3,086,529 | 4/1963 | Munz et al. | 24/204 X |
| 3,138,841 | 6/1964 | Naimer | 24/204 |
| 3,154,837 | 11/1964 | De Mestral | 28/72 P |
| 3,319,307 | 5/1967 | Marforio | 24/204 |
| 3,461,513 | 8/1969 | Girard et al. | 28/72 P |
| 3,464,094 | 9/1969 | Mates | 24/204 |
| 3,594,873 | 7/1971 | Huckmeyer, Jr. | 24/204 |

FOREIGN PATENTS OR APPLICATIONS

| | | | |
|---|---|---|---|
| 16,657 | 1/1895 | United Kingdom | 139/403 |
| 497,411 | 3/1937 | United Kingdom | 139/403 |
| 375,688 | 6/1932 | United Kingdom | 139/421 |
| 1,434,564 | 2/1966 | France | 139/391 |

*Primary Examiner*—James Kee Chi
*Attorney, Agent, or Firm*—Bacon & Thomas

[57] ABSTRACT

A hooking-up device consists of two supports usually ribbons, provided with hooking-up members engaged in interpenetrating relationship when the two supports are superposed. According to the present invention the interengaged supports have a good resiliency and elasticity at least in the longitudinal direction. The hooking-up members remain in mutual engagement during the entire elastic deformation of the device.

23 Claims, 5 Drawing Figures

14
13
11
12
19a
18
10
9
8
19
17
7
5
6
19a
16
4
2
3
19
15
1
13
14

30
37
28
36
37a
27
35
37b
26
25
34
37
24
33
23
37a
22
32
29a
29
21
37b
37b
31
29b
20
37a
37
30

HOOKING-UP DEVICE

The present application is a continuation-in-part of my co-pending patent application, Ser. No. 824,485, filed May 14, 1969 now abandoned.

This invention relates to a hooking or closing device consisting of two supports having hooking members adapted to be placed into interpenetrating relationship when the two supports are pressed one against the other.

Hooking devices consisting of two flexible parts provided with hooking members and intended to be applied against each other have been known for many years.

Swiss Pat. No. 339,155 discloses such a device in which the hooking members of one part are loops, while the hooking members of the other part are hooks. There is also known a hooking device consisting of two similar parts each having a plurality of loops forming a carpet having a given thickness as well as a plurality of hooks. The loop and hook devices are generally made by weaving or knitting processes. They are used in the garment industry (closing of clothes), in the furniture industry (seat covering, fixation of carpets), in the medical field (bandaging fixation) and the like.

Hooking devices consisting of two parts which are interpenetrated and made of a plastic or metallic material are also known. Swiss Pat. No. 385,539 discloses a hooking element consisting of a base foil of synthetic material, the surface of which has a very large number of closely adjacent projections which may engage projections of another similar element. These projections may be mushroom- or hook-shaped of the same material as that of the base foil and the element may be made, e.g. by injecting the synthetic material in a die.

A so-called metallic clamp hooking device has also been proposed. This device comprises two parts one of which has a large number of metallic hooks and the other, a large number of metallic loops, the hooks and the loops being retained in strips of plastic material.

These devices made of a plastic material or a metal have a high adherence force, but they are generally less flexible than the devices obtained by weaving or knitting and consequently, they are used for other purposes, e.g. for placing decorative panels or for fastening objects in vehicles of any type.

All the devices already proposed or used have a common feature in that they are not resiliently deformable in acceptable conditions, while being frequently very flexible. Now, in numerous applications, such resilient deformability is not only desirable, but often quite necessary, since otherwise such hooking or closing cannot be used. For instance, in the garment industry, extensible fabrics are frequently handled and, when using known hooking devices as closing means, that portion of the fabric on which the device is fastened, loses largely its resilient nature. ACcordingly, such hooking devices are not frequently used for linen underwear, corsets, various medical purposes and the like.

One of the objects of the present invention is to provide a hooking or closing device which may be subjected to important resilient deformations, namely under the effect of traction stresses, without being unhooked.

To obtain this purpose, the hooking or closing device according to the invention is characterized in that it is made to have resilient properties at least in one direction. Generally, said resilient properties are provided in the supports of the hooking elements. These resilient properties of the two supports may be similar or different and, in addition, one of the supports may be resilient, while the other is not.

Thus the present invention provides a hooking device having two woven supports provided with interengaging hooking members. At least one of the supports has an unidirectional permenent elasticity. The device is used in connection with women's undergarments, corsets, etc. One of the two supports has upwardly extending hook-shaped yarn portions, while the other support has upwardly extending loop-shaped yarn portions adapted to be engaged by the hook-shaped portions. Due to the elasticity the hooks and loops can be somewhat inclined relatively to each other. Thus the device of the present invention has a permanent elasticity which exists irrespective as to whether the device is open or closed.

In the resilient device of the present invention it will be possible, without adversely affecting a good hooking, to exert a traction stress with, consequently, a correlative extension of the device. The traction stresses in two opposite directions may be applied either simultaneously to both superimposed supports hooked with each other, either upon the one in one direction and, upon the other, in the opposite direction. When the resilient properties of both supports are identical, they will extend to the same length when said traction will be applied thereto and the hooking members which are interpenetrating will not be adversely shifted relatively to each other. In any case, they will be kept prefectly hooked. When the hooking device according to the invention is used for fastening two parts of a resilient fabric, it will be allowed to extend simultaneously with the fabric on which a traction is exerted. In this way, a flexible closing or fixation will be provided. On the contrary, when both supports show a different elasticity, the space must be always selected so that the average elasticity of the hooking or closing device is sufficient to absorb the stresses provided in the specific applications.

The attached drawings show by way of example an embodiment of the resilient hooking device forming the object of the invention.

Figure 1:
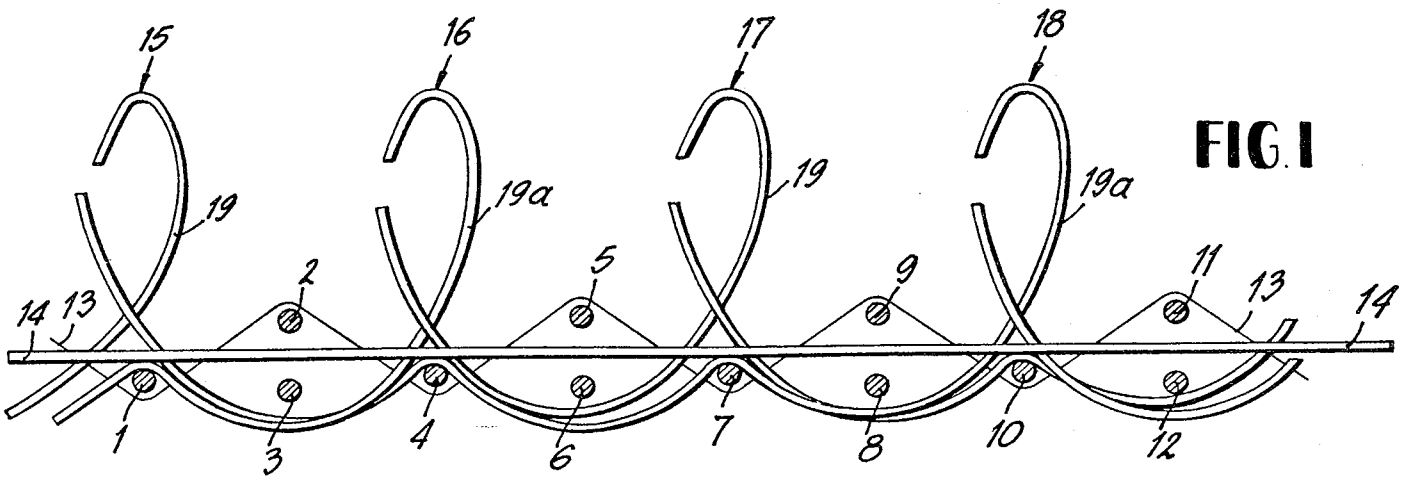
FIG. 1 shows a section through a length of a hook support of a hooking or closing device obtained by weaving.

In this embodiment, the hook tape represented in FIG. 1 is obtained by forming a support consisting of a weft comprising multifilament nylon yarns 1 to 12, and a warp comprising multifilament nylon yarns 13 and a stuffer warp of yarns 14 of a resilient, natural or synthetic material. The weft yarns 2–3, 5–6, 8–9 and 11–12 are disposed two by two one above the other and the resilient yarn 14 is passed between said pairs of weft yarns and on yarns 1, 4, 7, 10, etc. The warp multifilament nylon yarns 13 are passed in zigzags on weft yarns 1, 2, 4, 5, 7, 9, 10, 11, etc. The hooks 15, 16, 17, 18 are obtained by means of additional warp monoyarns 19 which are pile yarns. A first additional pile yarn 19 forms a cut loop represented by hook 15 and it passes then under the two weft yarns 2 and 3, then upon the weft yarn 4 to form a new cut loop hook 17 after being passed under the two weft yarns 5 and 6. When hook 17 is formed, the monoyarn 19 passes under the weft yarns 8 and 9, upon the weft yarn 10 and it forms a new hook (not shown) after being passed under weft yarns 11 and 12. The additional monoyarn **19*a* passes on the weft yarn 1, then under the two weft yarns 2 and 3 to form hook 16. It passes then under the two weft yarns 5 and 6, on the weft yarn 7 to form hook 18 after being passed under weft yarns 8 and 9**.

When the hook tape is woven, it is subjected to a thermal treatment for fixing completely the foundation and the loops of monoyarns 19 which, after cutting, will become hooks 15, 16, 17, 18 . . . . The temperature and the time during which this treatment is applied depend upon the used yarns. During said treatment, it is generally necessary to tighten the tape without extending it so that it will be perfectly flat. With the view of preserving a good elasticity and improving the taped body and also with the view of sizing firmly, in the foundation fabric, the loops which will become hooks 15 to 18 after cutting, the tape is sized by coating or scraping a sizing product having a permanent elasticity, e.g. a latex.

When sizing, the tape is subjected to some tension which must be such that it is not extended during the scraping and drying operation. The sizing film substantially cured by this treatment provides a sufficient binding of the hooks in monoyarns, it being however possible to stretch and to relieve the tape at will without deforming the hooks or the fabric. In order to cut the monoyarn loops 19, thereby forming the hooks, the tape is stretched so that the loops may be cut without any difficulty.

The hook tape represented in FIG. 1 may be extended by 100% so that its length may be doubled. When examining FIG. 1, it will be observed that the resilient yarn 14 is extended when the tape is stretched. The foundation yarns 13 and the additional monoyarns 19 which are not resilient and which may not accordingly be extended are however passed in zigzags between the weft yarns 1 to 12 of the foundation in such manner that, when the tape is extended, they may be flattened and increased in length in the traction direction, i.e. also in the direction of the deformation of the hooking or closing device.

Figure 2:
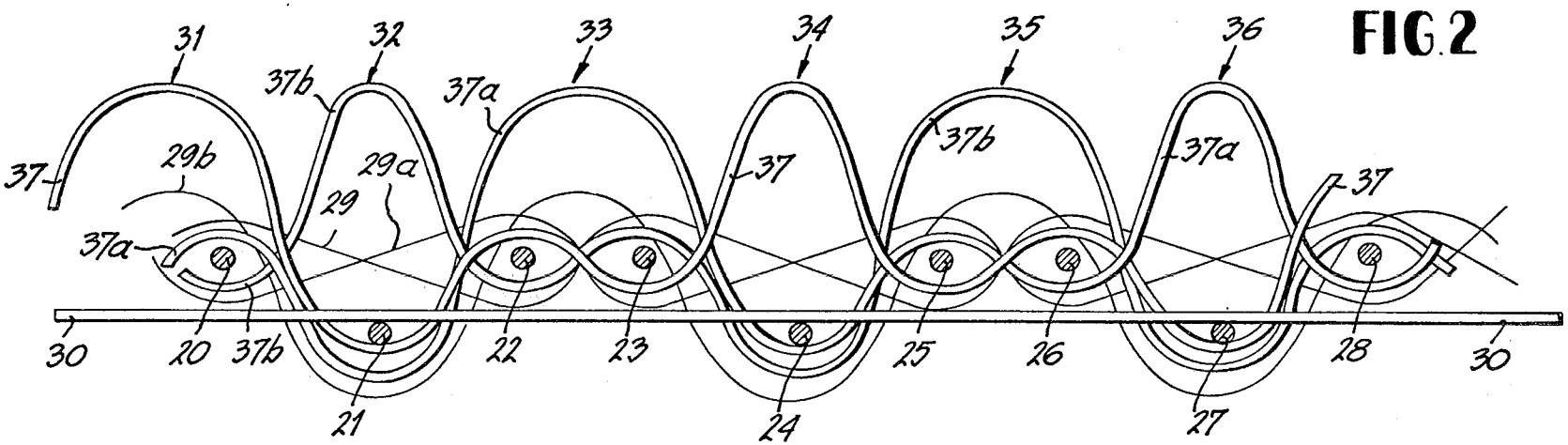
FIG. 2 shows a section through a length of a loop support of a hooking or closing device obtained by weaving. Both supports are intended to be applied and pressed against each other in the hooking or closing position of the device.

The loop support a section of which is shown in FIG. 2 is woven in the same manner as the hook tape of FIG. 1. The loop tape is obtained by forming a foundation comprising weft multifilament nylon yarns 20 to 28 and warp yarns comprising multifilament nylon yarns **29, 29*a* and a stuffer warp of 29*b* and natural or synthetic resilient yarns 30**.

The resilient yarn 30 passes under the weft yarn 20, above the weft yarn 21, under the two following weft yarns 22 and 23 adjacent to each other, above the weft yarn 24, etc. The foundation warp yarns 29 and **29*a* are passed in zigzags about the weft yarns 20 to 28, the foundation yarn 29*b* passing also in zigzags about the weft yarns 20 to 28, but always on the two weft yarns adjacent to each other 22, 23, 24, 25, etc. The loops 31 to 36 are obtained by means of additional warp yarns 37, 37*a* and 37*b* which are pile yarns passing in zigzags between the weft yarns 20 to 28 and spanning the resilient yarns 30**.

When finishing, said tape, like the hook tape, is also subjected to a thermal treatment, then the loops 31 to 36 formed by means of monoyarns **37, 37*a* and 37*b* and the foundation consisting of weft yarns 20 to 28 and warp yarns 29, 29*a*, 29*b* and 30 are sized for applying a resilient size upon the back face of the support, like the hook support. The loop support just described has resilient characteristics which may be similar to or different from those of the hook support described with reference to FIG. 1**. Since the resilient yarn may be extended and the weaving of the warp yarns is in zigzags, the loop support could be also extended by 100% for the same reasons as those pertaining to the hook support. Assuming that the loop support and the hook support are interpenetrating and then subjected to a traction, under the effect of said traction, they will extend in accordance with the traction stress and the interpenetrating loops and hooks will be always kept substantially facing each other and they will not be subjected to any detrimental stress. Thus, they will be kept firmly hooked to each other.

The resilient hooking device disclosed herein may be applied to infinitely varying purposes in any industrial, domestic, scientific, sporting, medical, agricultural and similar field. By way of a non-limitative example, it may be used in the manufacture of corsets, for some types of linen underwear and in medical applications such as the fixation of resilient bandages.

It is apparent that it is possible to provide a single type of resilient support having loops forming a carpet having a given thickness and hooks which may emerge from the loop carpet. In one case, it is then sufficient, when weaving, to form two loop carpets having different thicknesses and, after the thermal treatment and after fixing the resilient size to the tape back, to cut the carpet loops having the largest thickness to form hooks. In this embodiment, it will not be necessary any more to adapt the resilient characteristics of the loop support and the hook support, the same support fulfilling both functions.

The device disclosed in the attached drawings has a resilient character in a single direction, i.e. according to the warp, which is amply sufficient for conventional applications. However, those skilled in the Art will be able to realize very readily a weaving with resilient weft yarns or weft yarns passing in zigzags on the warp yarns, thereby providing resilient properties in two directions.

Figure 3:
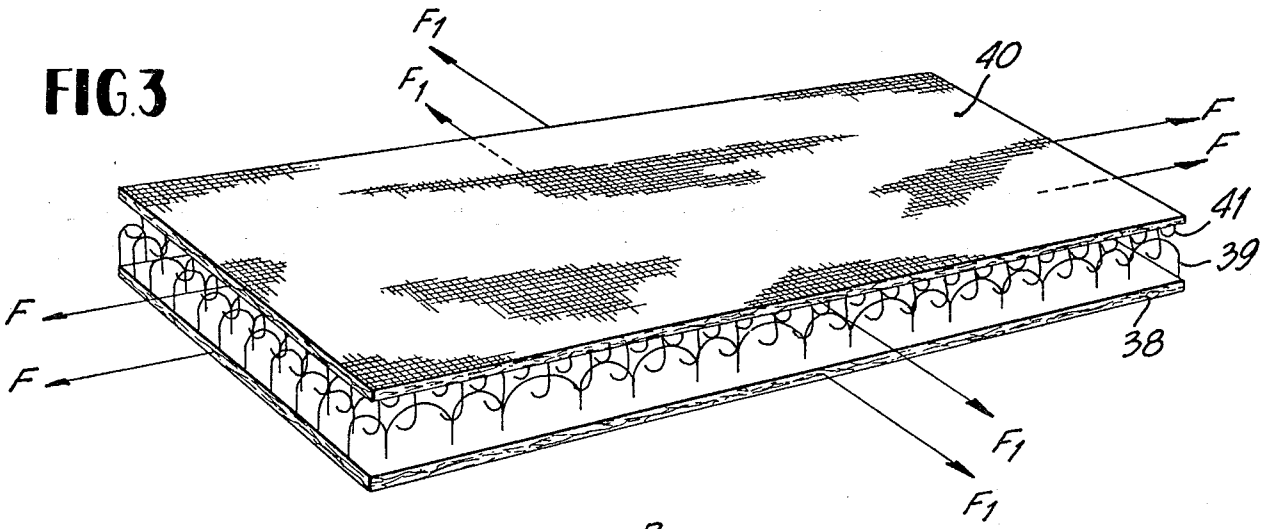
FIG. 3 shows a perspective view of a length of the resilient hooking and closing device according to the invention.

Such embodiment is shown diagrammatically on FIG. 3 in which the arrows F indicate the longitudinal traction directions whereas the arrows $F_1$ indicate the transverse traction directions.

This embodiment includes the support 38 bearing some suitable hooked elements or loops 39 and the support 40 having some suitable hooking elements or hooks 41.

Similar closing and hooking devices having a multidirectional elasticity degree could be also provided.

In addition, instead of the hook tape, it is also possible to use a support of rubber or synthetic material obtained by stamping and having a plurality of projections, e.g. mushrooms which will be hooked into the loops of the astrakan tape described with reference to FIG. 2.

Furthermore, the loop tape may be obtained by means of a support of rubber or synthetic material identical to that bearing projections, the loops being embedded or adhered thereto. In the case of an embodiment in which the loops and the hooks or mushrooms are of metal, it is possible to form the tapes by stamping or by stocking, i.e. by throwing the metallic hooks and loops on a support, e.g. by a magnetic process. It is also possible to use a tufting process similar to that used in the manufacture of carpets in which, e.g. loops and hooks are stitched on a resilient woven support or on a grid of rubber or synthetic material.

The binding devices obtained with a support of rubber or synthetic material and metal hooking members may be naturally subjected to greater forces than a device obtained by weaving and intended, e.g. to connect transmission belts or to secure tarpaulins on a vehicle.

The elements of the hooking device could be then fastened on the parts being connected by riveting, screwing or any other suitable means.

The above described means have been mentioned only by way of example. It is apparent that male and/or female hooking supports could be obtained by infinitely varying means, provided that the support in any suitable material is somewhat resilient and also provided that at least one of the faces has hooking elements and/or hooked elements so that two such supports being superimposed and pressed are firmly interconnected, while preserving a good resilient deformability at least in one direction.

It results that such supports could be produced not only by weaving, but also by pressing, rolling, extraction, injection, projection, tagging, knitting, flocking, etc. Any suitable natural or synthetic material may be also used.

Figure 4:
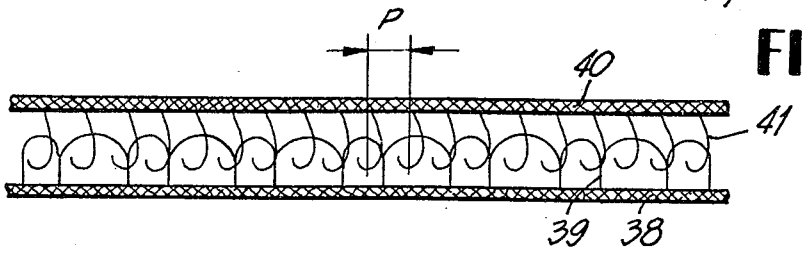
FIG. 4 shows a section of a length of a hooking and closing device according to the invention, represented in interpenetrating position, but not subjected to any traction stress.
Figure 5:
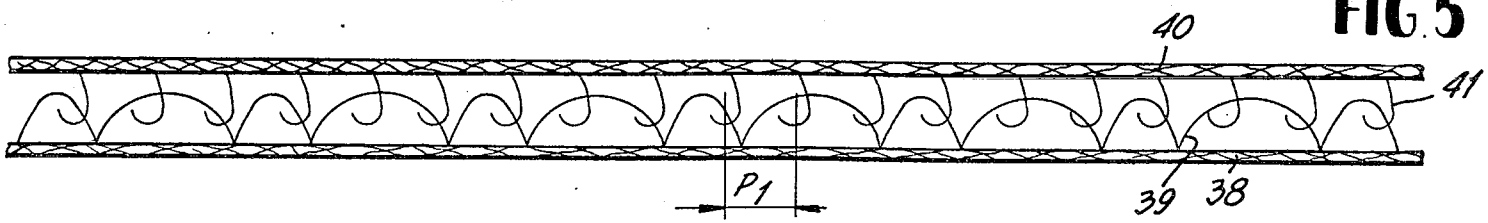
FIG. 5 is similar to FIG. 4, the length of the resilient hooking and closing device being shown after extension by resilient deformation.
Figure 1:
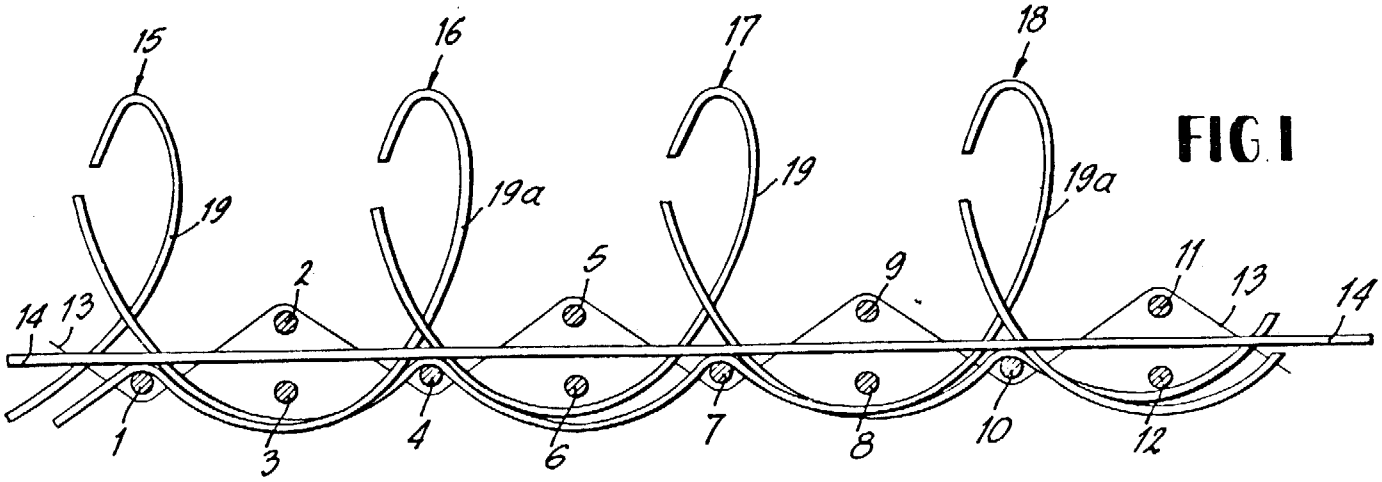

In any case, in the direction or directions of resilient deformation or extension, the supports will operate in a manner shown diagrammatically in FIGS. 4 and 5, respectively in their position before and after a tensile stress. Practically, the result will be that the pitch P between two adjoining hooking elements (FIG. 4) will become, after a resilient deformation, $P_1$ P, it being understood that, after the tensile stresses, the said pitch will com back automatically to the value *P*. It follows that the relative position of the hooking and the hooked elements respectively of the one and the other support of the concerned resilient closing or hooking device will be kept substantially constant and, in any case, within acceptable deformation limits, i.e. without any reduction or without detrimental reduction of the hooking force of the hooking elements.

The following is a summary of the various features of the present invention.

The two supports have permanent elasticity which may be identical or different. The elasticity may be determined by the material from which the supports are made or by the manufacturing method. Elastic elements in the supports may be combined with elements having less elasticity or no elasticity at all. The supports may consist of woven yarns and the hooking-up members may be loops and hooks formed by additional warp yarns disposed between the weft yarns and having twice the length of the supports. However the supports may also consist of rubber or synthetic material and the hooking-up members may be stiched or otherwise fixed to the supports. The hooks may be replaced by projections or mushroomlike parts and may be made of metal or other suitable material.

When the supports consist of elastic weft yarns and non-elastic yarns, the non-elastic yarns may be disposed zigzag about the weft yarns or located in the shed of the warp yarns.

Each of the supports may be made by weaving and may have three warps, namely a warp of synthetic yarns, a warp of elastic yarns and a warp of synthetic pile yarns, the weft also consisting of synthetic yarns. There may be a double ground warp consisting of a first warp of multifilament polyamide yarns and a second warp of synthetic rubber yarns. The first warp may consist of 160 multifilament polyamide yarns of 140 deniers 600 T/Z, 400 T/S, while the second warp may have 37 synthetic rubber yarns. The pile warp may have monofilament polyamide yarns, for example, 35 monofilament polyamide yarns having a diameter of 0.18 mm. The weft yarn may consist of multifilament polyamide yarn of 200 deniers, 200 T/Z normal.

The warp repeat for making a hooking-up element having a 30 mm. width may be as follows:

for the left selvedge
1 synthetic rubber yarn
10 polyamide yarns 140 deniers
for the center 35×
2 polyamide yarns 140 deniers
1 synthetic rubber yarn
1 polyamide pile yarn $\phi$ 0.18 mm.
2 polyamide yarns 140 deniers
for the right selvedge
10 polyamide yarns 140 deniers
1 synthetic rubber yarn.

The above combination may be varied as follows:

for the left selvedge
1 synthetic rubber yarn
16 polyamide yarns 140 deniers
for the center 32×
1 polyamide yarn 140 deniers
1 polyamide pile yarn 90 deniers
1 polyamide yarn 140 deniers
1 synthetic rubber yarn
1 polyamide yarn 140 deniers
1 polyamide pile yarn 90 deniers
1 polyamide yarn 140 deniers
for the right selvedge
16 polyamide yarns 140 deniers
1 synthetic rubber yarn During the formation of the hooking-up element monofilament loops may be formed which span within the ground fabric at least two polyamide ground fabrics, an elastic yarn and a temporary support contributing to the formation of the loops. A group comprising four polyamide ground yarns, an elastic yarn and a pile is drawn every time in the same opening of the loom reed. During the formation loops span locally the temporary supports. For example, a group comprising four ground yarns, an elastic yarn and two pile yarns, as well as two temporary supports is passed in the same opening of the weaving reed.

A resilient finish may be applied to the back face of each element to size the loops and the hooks. This finish may contain rubber or latex and water.

I claim:

1. In a fabric fastener having first and second woven support members formed of weft and warp including raised elements of complementary geometrical configuration adapted for interpenetration therebetween whereby said support members are held in intimate relationship, the improvement comprising:

a. a weft comprising a plurality of yarns, b. a warp comprising a plurality of yarns including 1. a ground warp comprising a plurality of yarns interwoven with said weft yarns, 2. a stuffer warp in at least one of said support members comprising a plurality of elastic yarns, and 3. a pile warp comprising a plurality of yarns interwoven with said weft and forming said raised elements, wherein at least one of said support members is stretchable over a range of up to at least twice its unstretched length in at least one axial direction thereof, and wherein the length of the yarns comprising the ground and pile warps interwoven within the support having the elastic stuffer warp is sufficient to provide means for permitting recoverable extensibility over said range while said support members are in intimate relationship without loss of interpenetration of said elements.

2. In a fastener as defined in claim 1, wherein said stuffer warp is included in each of said support members.

3. In a fastener as defined in claim 2, wherein each of said support members exhibits substantially identical permanent elasticity.

4. In a fastener as defined in claim 2, wherein each of said support members exhibits substantially different permanent elasticity.

5. In a fastener as defined in claim 1, wherein one of said raised elements formed from one of said plurality of yarns is immediately proximate another of said raised elements formed from another of said plurality of yarns.

6. In a fastener as defined in claim 1, wherein said weft further comprises:

a. pairs of yarns forming a first weft set; and, b. individual yarns forming a second weft set.

7. In a fastener as defined in claim 6, wherein said stuffer warp in one of said supporting members is disposed intermediate said first and second weft sets.

8. In a fastener as defined in claim 6, wherein said stuffer warp in one of said support members is disposed:

a. intermediate said pairs of yarns forming said first weft set; and, b. above said second weft set.

9. In a fastener as defined in claim 7, wherein a first of said plurality of yarns comprising said ground warp is interwoven over said first weft set and under said second weft set.

10. In a fastener as defined in claim 8, wherein:

a. a first of said plurality of yarns comprising said ground warp is interwoven over said first weft set and under said second weft set; and, b. the remainder of said plurality of yarns comprising said ground warp are interwoven alternately with said first weft set only.

11. In a fastener as defined in claim 5, wherein each of said plurality of yarns forming said raised elements has a length approximately twice that of said support member when said support member is in the unstretched condition.

12. In a fastener as defined in claim 5, wherein said raised elements on one support member comprise hooks and the raised elements on the other of said support members comprise loops.

13. In a fastener as defined in claim 1, wherein at least one of said yarns is elastic.

14. In a fastener as defined in claim 1, wherein at least one of said yarns is synthetic.

15. In a fastener as defined in claim 1, wherein said stuffer warp yarns are synthetic rubber.

16. In a fastener as defined in claim 14, wherein said synthetic yarns are multifilament polyamide yarns.

17. In a fastener as defined in claim 1, wherein said weft includes multifilament polyamide yarns of 200 deniers, 200 T/Z normal.

18. In a fastener as defined in claim 5, wherein said raised elements on one of said supports comprise loops.

19. In a fastener as defined in claim 1, further including a backing finish of resilient material whereby each of said woven support members is sized.

20. In a fastener as defined in claim 19, wherein said resilient backing includes rubber.

21. In a fastener as defined in claim 19, wherein said resilient backing includes latex.

22. In a fastener as defined in claim 1, wherein said pile warp yarns are metal yarns.

23. In a fastener as defined in claim 1, wherein said raised elements comprise mushroom-shaped geometrical configurations.

* * * * *

UNITED STATES PATENT OFFICE
CERTIFICATE OF CORRECTION

Patent No. 3,943,981 Dated March 16, 1976

Inventor(s) Jean Leon Philemon Isidor Pierre De Brabander

It is certified that error appears in the above-identified patent and that said Letters Patent are hereby corrected as shown below:

On the Title page, the illustrative figure and FIG. 1, should appear as shown on the attached sheet.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*

UNITED STATES PATENT OFFICE
CERTIFICATE OF CORRECTION

Patent No. 3,943,981 Dated March 16, 1976

Inventor(s) Jean Leon Philemon Isidor Pierre De Brabander

It is certified that error appears in the above-identified patent and that said Letters Patent are hereby corrected as shown below:

On the Title page, the address of the Assignee should read "Nyon, Switzerland".

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*